US006484744B1

(12) United States Patent
Tseng

(10) Patent No.: US 6,484,744 B1
(45) Date of Patent: Nov. 26, 2002

(54) OIL PUMPING DEVICE

(76) Inventor: Tien Tsai Tseng, No. 771, Lin Sen Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/935,649

(22) Filed: Aug. 24, 2001

(51) Int. Cl.[7] ..... F04F 3/00
(52) U.S. Cl. ..... 137/205; 184/1.5
(58) Field of Search ..... 137/205; 184/1.5

(56) References Cited

U.S. PATENT DOCUMENTS 5,002,154 A * 3/1991 Chen ..... 184/1.5
5,450,924 A * 9/1995 Tseng ..... 184/1.5
6,112,759 A * 9/2000 Hsu ..... 137/148

* cited by examiner

*Primary Examiner*—Gerald A. Michalsky
(74) *Attorney, Agent, or Firm*—Rosenberg, Klein & Lee

(57) ABSTRACT

An oil pumping device includes an oil storage tank. An upright pump is installed between the upper cover and lower cover of the oil storage tank. The interior of the pump is installed with a piston and a unidirectional air inlet valve. The outer peripheral surface of the oil storage tank has a recess. The recess has an air inlet hole which is hollowed radially. Therefore, when the piston rod is pulled upwards or downwards repeatedly, the oil in the oil tank can be absorbed to the oil storage tank.

7 Claims, 5 Drawing Sheets

OIL PUMPING DEVICE

FIELD OF THE INVENTION

The present invention relates to an oil pumping device, and particularly to an oil pumping device which can be assembled easily.

BACKGROUND OF THE INVENTION

Referring to FIG. 8, a plurality of handhold oil absorbing device is illustrated. The device has an oil storage tank 7. The upper cover 71 and lower cover 72 of the oil storage tank are connected to an upright pump 8. The pump 8 has a piston 81 therein. The piston rod 82 of the piston 81 passes out of the upper cover 71 of the oil storage tank 7 and a handle 83 is installed for being operated by the user. The upper cover 71 has an air inlet channel 711. The channel 711 is communicated with the pump 8 and the oil storage space 73 of the oil storage tank. The inlet 712 of the air inlet channel 711 of the upper cover 71 has a unidirectional air inlet valve 713. The unidirectional air inlet valve 713 is installed with a ballcock 714. The lower cover 72 is installed with a unidirectional pressure relief valve 9. The pressure relief valve 9 is within the pump 8.

When the handle is pulled upwards so as to lift the piston 81, the air above the piston 81 will be extruded to flow to the lower side of the piston 81. When the piston rod 82 is pushed so that the piston 81 descends, then the air below the piston 81 will be released from the pressure relief valve 9, and the air above the piston 81 will decrease so that air in the oil storage space 73 flows through the unidirectional air inlet valve 713 to enter into the pump 8. Therefore, oil flows to the oil storage space 73 through an air absorbing tube. When the piston rod 82 is pulled upwards and downwards repeatedly, oil in the oil storage tank is absorbed and flows to the oil storage tank 7. When the oil in the oil storage tank has achieved to a predetermined height, the ballcock 714 moves upwards to close the unidirectional air inlet valve 713 to prevent oil from entering into the pump 8.

The prior oil pumping device has the following disadvantages.

1. In assembly, the unidirectional air inlet valve 713 and pressure relief valve 9 and other components are installed to the upper cover 71 and lower cover 71 individually. Then the upper cover 71, lower cover 72 and pump 8 are assembled together. The process is complex.
2. Since the upper cover 712 must have an inlet 712 and an air inlet valve 713, oil tubes and other components are necessary. Therefore, a predetermined thickness and cross section are necessary. The cost in material is increased. Furthermore, the gravitational center is high, and thus it is unstable.
3. The upper cover 71 is formed with an air inlet channel 711.

The air inlet channel 711 must be communicated with the pump 8 and the oil storage space 73 so as to have an approximate L shape. The process is complex. To install a unidirectional air inlet valve 713 to the upper cover 71, more machining processes are necessary.

4. Although the ballcock 714 is used to prevent oil from flowing into the pump 8, more parts are necessary for installing the ballcock. The assembly work is complex. Besides, since the ballcock 714 is connected to a driven device so that as the ballcock lifts, the air inlet valve is closed. If the assembly work is not very precise or some parts have faults. The driven device can not work in normal so that the unidirectional air inlet valve can be not closed.

SUMMARY OF THE INVENTION

Accordingly, the primary object of the present invention is to provide an oil pumping device, wherein an unidirectional air inlet valve is installed directly in a pump. The pump has an air inlet hole and an oil storage tank formed by air inflation is used in the present invention. Therefore, the process and cost in manufacture is reduced.

To achieve above objects, the present invention provides an oil pumping device including an oil storage tank. An upright pump is installed between the upper cover and lower cover of the oil storage tank. The interior of the pump is installed with a piston and a unidirectional air inlet valve. The outer peripheral surface of the oil storage tank has a recess. The recess has an air inlet hole which is hollowed radially. Therefore, when the piston rod is pulled upwards or downwards repeatedly, the oil in the oil tank can be absorbed to the oil storage tank.

The various objects and advantages of the present invention will be more readily understood from the following detailed description when read in conjunction with the appended drawing.

DETAILED DESCRIPTION OF THE PREFERRED EMBODIMENTS

Figure 1:
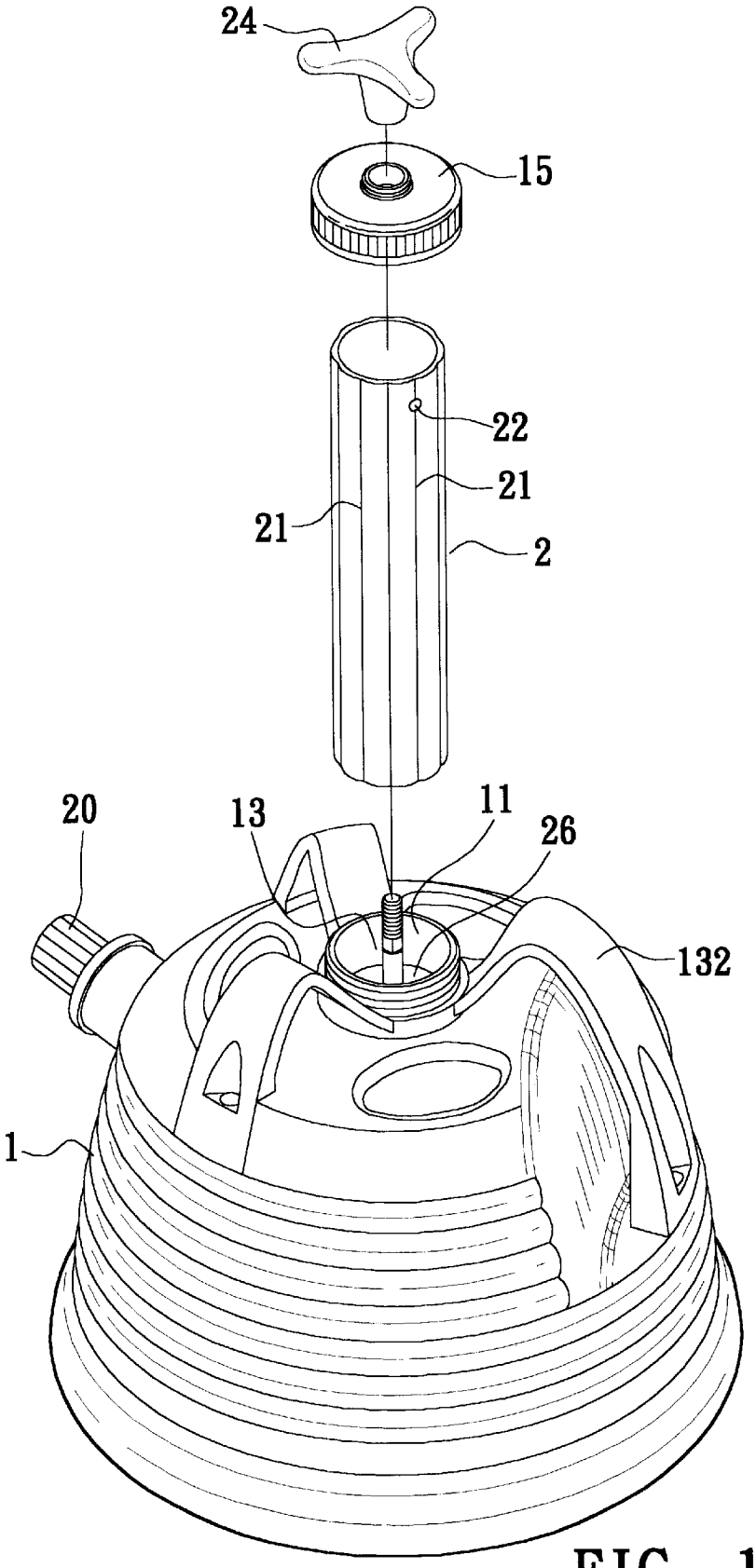
FIG. 1 is an exploded view of the present invention.

Referring to FIGS. 1 to 7, the present invention is an oil pumping device. The oil pumping device of the present invention includes an oil storage tank 1 which is made of transparent or semitransparent material and by blowing to from the shape. The oil storage tank 1 has an upper opening 11 and a lower opening 12. The edges of the upper opening 11 and the lower opening 12 are respective annular upper positioning wall 13 and lower positioning wall 14. The top and bottom of one pump 2 are inserted to the inner sides of the upper positioning wall 13 and lower positioning wall 14. The top and bottom of the pump 2 are sealed by an upper cover 15 and a lower cover 16 which are screwed to the upper opening 11 and lower opening 12. The outer side of the pump 2 of the oil storage tank 1 has an oil sealing 19 for preventing oil from draining. The oil storage tank 1 has an oil inlet 18. The oil inlet 18 is connected to a seat 20. The seat 20 is connected to the oil absorption tube (not shown) which extends outwards. The oil storage tank 1 has a handle 13 at a side of the oil storage tank 1 with respect to the seat 20.

In this embodiment, the peripheral surface of the pump 2 has a plurality of recesses 21 which extends axially and penetrates through the pump 2. The upper section of the recesses 21 are enclosed by the upper positioning wall 13. Other portion is protruded from the upper positioning wall 13 to be below the upper positioning wall 13. Each recess 21 has an air inlet hole 22 at a position with respect to the upper positioning wall 13 and radially hollowed inwards. The recess 21 is communicated with the interior of the pump 2. The air inlet hole 22 is higher than the top 131 of the oil storage tank 1. The interior of the pump 2 has a sealing cover 26 at a proper position near the top thereof. The elevation of the sealing cover 26 is lower than that of the air inlet hole 22.

Figure 2:
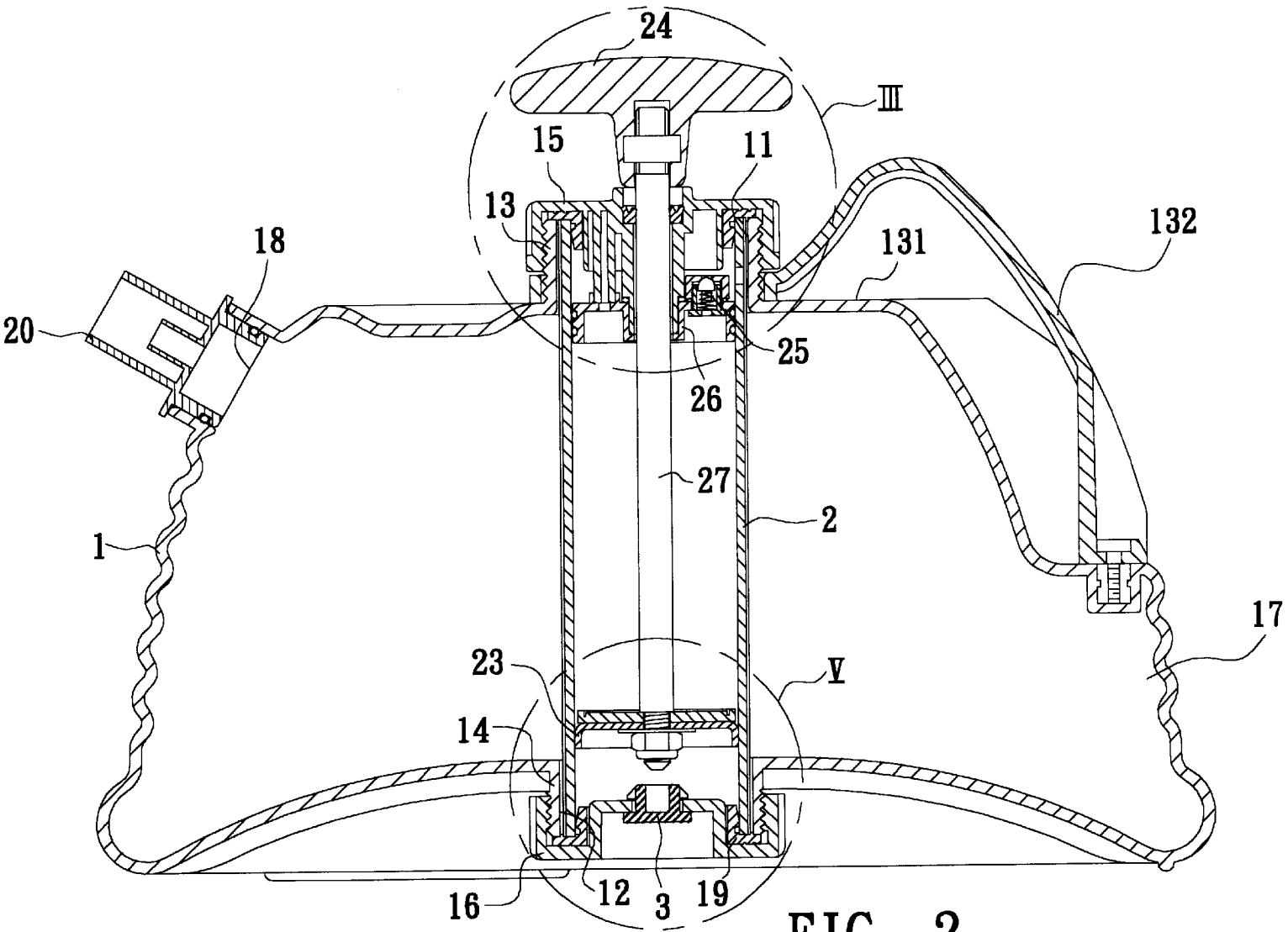
FIG. 2 is a cross sectional view of the present invention.
Figure 3:
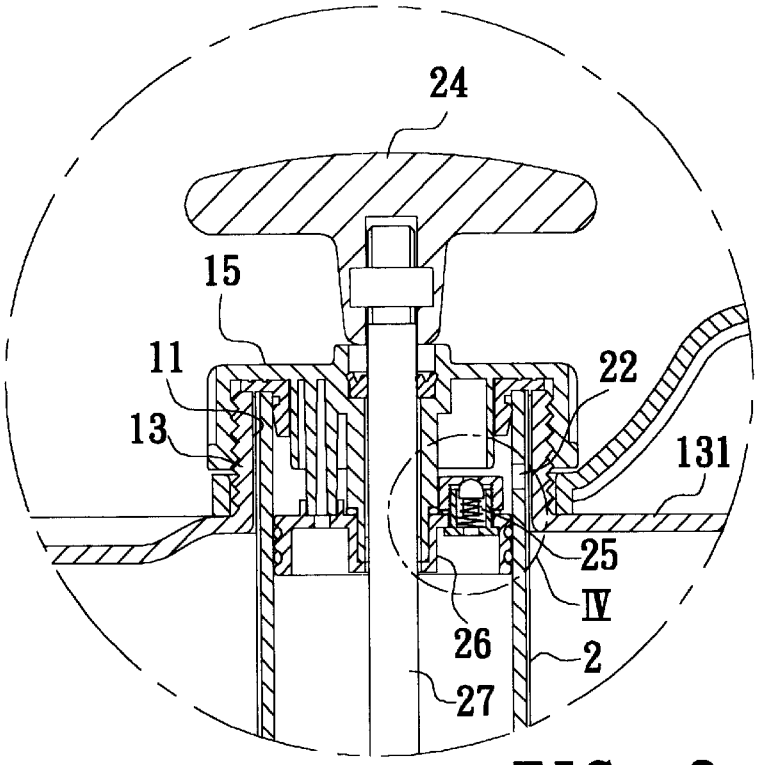
FIG. 3 is an enlarge view of the III in FIG. 2.

Besides, as illustrated in FIG. 2, a piston 3 is installed in the pump 2. The piston rod 27 of the piston 253 passes out of the sealing cover 26 and the upper cover 15 to be installed with a handle 24.

Figure 4:
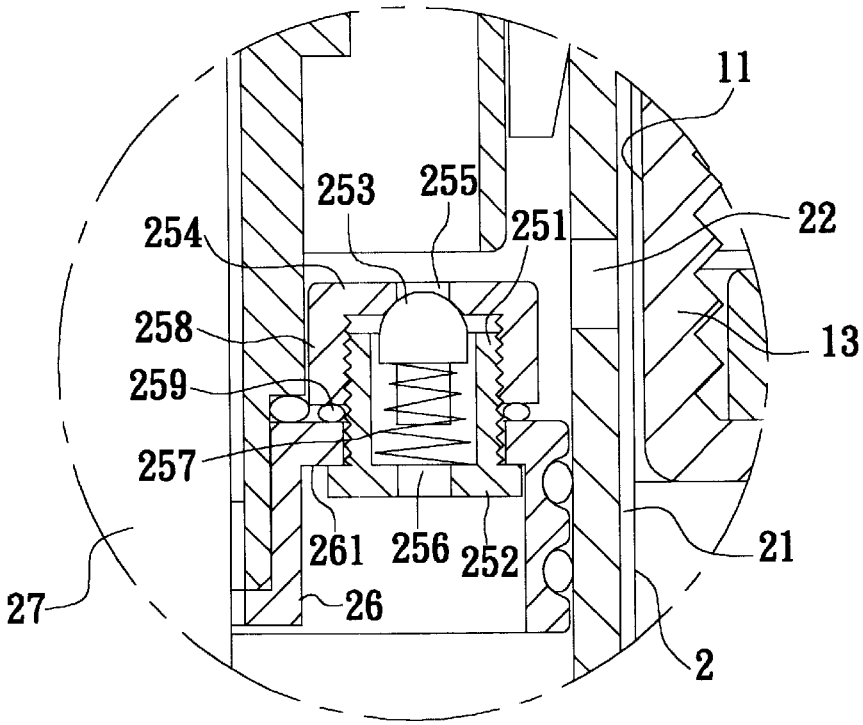
FIG. 4 is an enlarged view of the IV in FIG. 3.

As shown in FIG. 4, the sealing cover 26 is installed with a unidirectional air inlet valve 25. The unidirectional air inlet valve 25 has a tubular valve body 251 and a cover 254. The valve body 251 passes through the sealing cover 26 and the bottom thereof has an under pan 252 with a larger diameter. When the valve body 251 is installed in the sealing cover 26, the under pan 252 will buckle the bottom 261 of the sealing cover 26. The under pan 252 has an air hole 256 penetrating through the under pan 252. By the downward extending peripheral wall 258, the cover 254 is screwed to the outer lateral surface of the top of the valve body 251 so as to be installed to the valve body 251. The cover 254 has an air hole 255 penetrating through the top of the cover 254. An 0 ring 259 is installed between the peripheral wall 258 of the cover 254 and the sealing cover 26. The interior of the valve body 251 is installed with a piston 253 and an elastomer (for example, a spring 257). One end of the spring 257 resists against the under pan 252 of the valve body 251 and another end thereof resists against the piston 253. In normal condition, the piston 253 is ejected by the spring 257 upwards to seal the air hole 255 of the cover 254.

Figure 5:
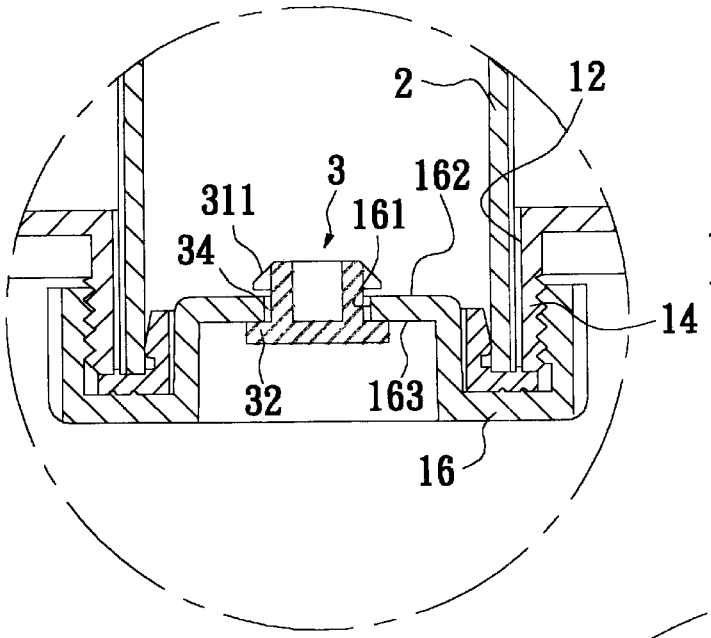
FIG. 5 is an enlarged view of the V in FIG. 2.
Figure 6:
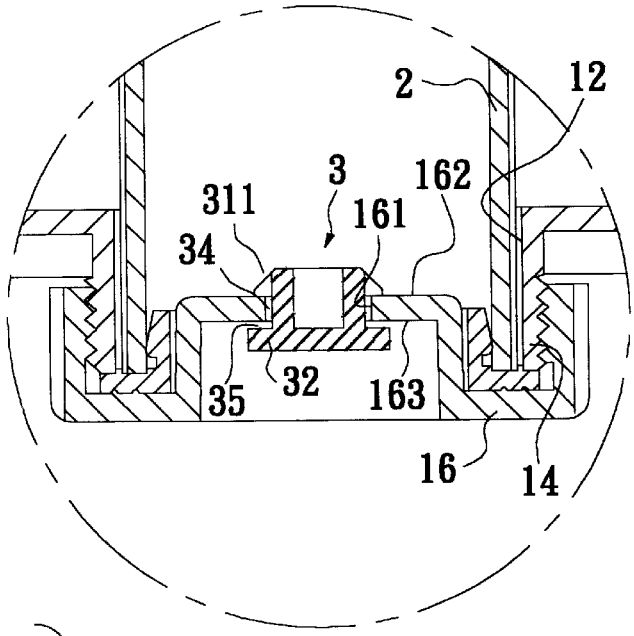
FIG. 6 shows that a unidirectional pressure relief valve is extruded downwards.
Figure 7:
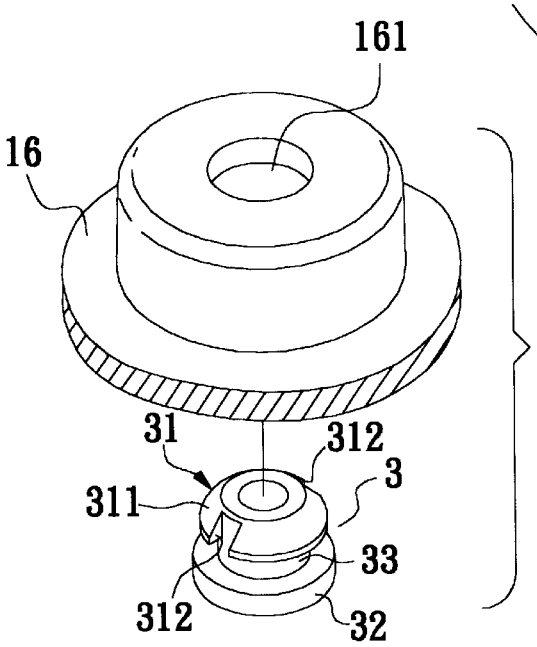
FIG. 7 shows the operation of the unidirectional pressure relief valve of the present invention.
Figure 8:
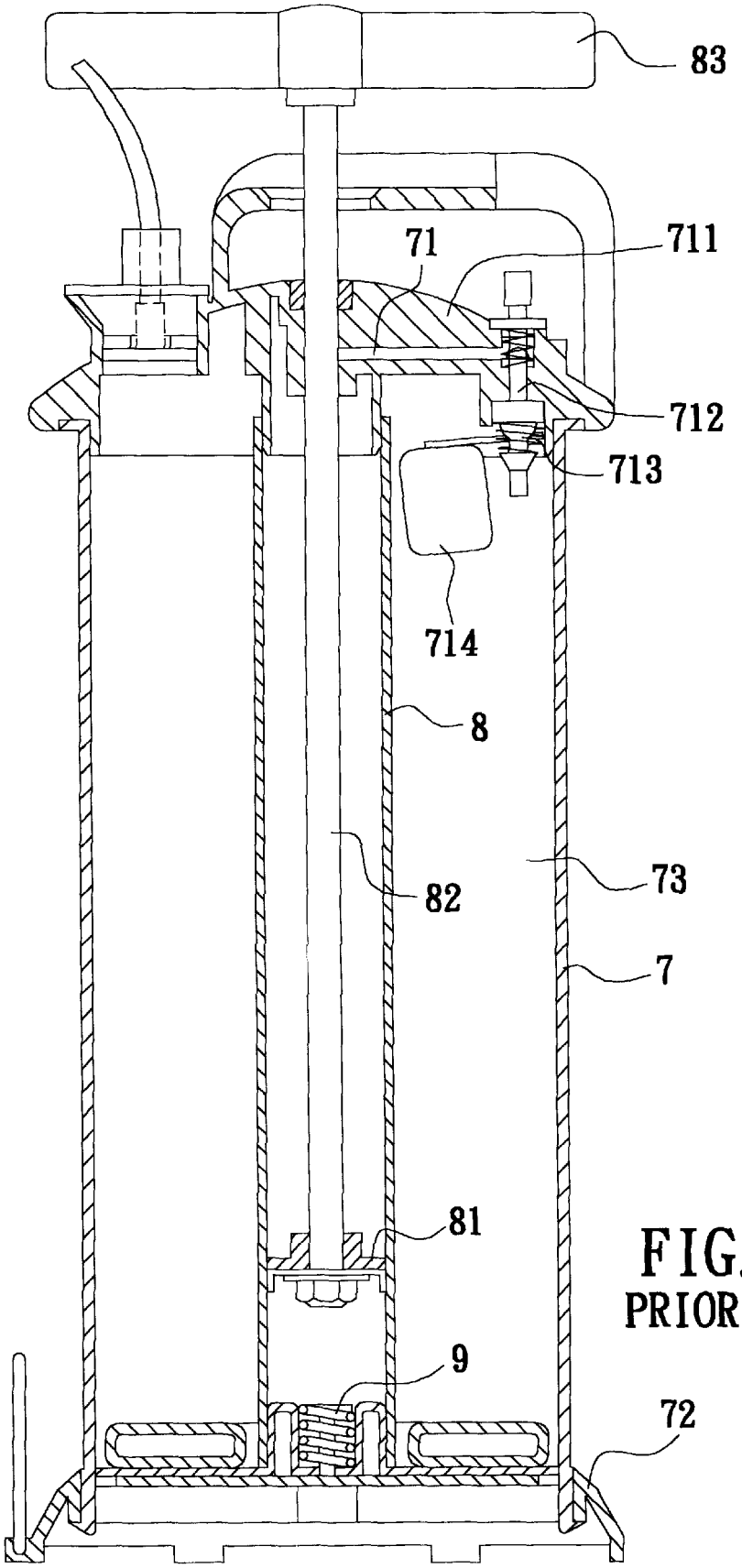
FIG. 8 PRIOR ART
FIG. 8 is a cross sectional view of a prior oil pumping device.

Referring to FIGS. 5 to 7, the lower cover 16 with respect to the interior of the pump has a penetrating engaging hole 161. A unidirectional pressure relief valve 3 which is elastic and has a post-like shape is inserted into the engaging hole 161. The top of the valve 3 has a taper portion 31 with a configuration reduced toward the top end thereof. The peripheral surface of the taper 31 is formed with a tilt guide surface 311. The maximum diameter of the taper portion 31 is larger than the diameter of the engaging hole 161. The outer edge of the taper portion 31 has two dents 312 axially penetrating through the taper portion 31. The bottom of the pressure relief valve 3 has an under pan 32 having a larger diameter. The diameter of the under pan 32 is larger than the diameter of the engaging hole 161. A neck portion 33 with a smaller diameter is formed between the taper portion 31 and the under pan 32. The outer diameter of the neck portion 33 is smaller than the diameter of the engaging hole 161. The thickness of the neck portion 33 is larger than the thickness of the engaging hole 161 so that a longitudinal air flowing space 34 is formed between the neck portion 33 and the engaging hole 161. The air flowing space 34 is communicated with the dent 312.

When the user holds the handle 24 to pull upwards so that the piston 23 lifts upwards, air above the piston 23 is extruded to flow to the lower side of the piston 23. When the user pull the piston rod so that the piston 23 descends, the piston 23 will extrude air in the lower side so that the air pushes the unidirectional air inlet valve 3, thereby, the taper portion 31 resists tightly against the upper lateral surface 162 of the lower cover 16. Thereby, a transversal air flowing space 35 is formed between the lower lateral surface 163 of the lower cover 16 and the under pan 32. The transversal air flowing space 35 is communicated with the longitudinal air flowing space 34 so that that air between the piston 23 and the lower cover 16 flows through the dent 312 and then passes through the air flowing space 34 and the air flowing space 35 to be exhausted out of the oil storage tank 1. The air pressure above the piston 23 will reduce so that the air in the oil storage space 17 enters into the recess 21 and then passes through the air inlet hole 22 to enter into the place above the sealing cover 26 in the pump 2. Now, air passing through the air inlet hole 22 will push the piston 253 so that the piston 252 extrudes the spring 257 so that air flows through the air hole 255 of the cover 254 to flow into the valve body 251. Then the air flows through the air hole 256 on the under pan 252 of the valve body 251 to the lower side of he sealing cover 26. Thereby, the air pressure of the oil storage space 17 decreases so as to push oil to enter into the oil storage space 17 through an oil absorbing tube. Therefore, when the piston rod is pulled upwards or downwards repeatedly, the oil in the oil tank (not shown) can be absorbed to the oil storage tank 1. When the oil in the oil storage tank 1 is to be poured out, the user is only necessary to pull out the seat 20 and hold the handle 132 so that oil is poured out from the oil inlet 18.

It should be known that the head 33 of the unidirectional air inlet valve 3 has a diameter identical to the diameter of the engaging hole 161. Only the peripheral surface of the neck portion 33 has a recess communicated to the dent 312. When air presses the pressure relief valve 12 downwards, the recess extends downwards to protrude out from the lower cover. Thereby, air may be exhausted out of the pump 2 through the dent 312 and the recess 21.

It is known from above description that two ends of the pump 2 of the present invention are directly inserted into the inner sides of the upper positioning wall 13 and the lower positioning wall 14 so as to resist against the upper cover 15 and lower cover 16. Therefore, no other means are necessary for positioning the pump 2.

Besides, since in the present invention, an air inlet valve 25 is directly installed in the pump 2, in assembly, the air inlet valve 25 can be firstly installed to the pump 2 and then the pump 2 is installed in the oil storage tank 1. This is a convenient way. The upper cover 15 is only a simple and thinner cover. Thereby, cost is reduced.

Besides, since the air inlet hole 22 is higher that the top 131 of the transparent or semitransparent oil storage tank 1. Even no ballcock is installed the level of the oil in the oil storage space 17 can be viewed easily. It is necessary to pump oil continuously. Therefore, it may prevent the oil from flowing into the pump 2 in the oil storage space 17.

Moreover, since in the present invention, the air inlet valve 25 is installed in the pump 2 and the pump 2 has air inlet channels, the volume of the top of the oil pumping device can be reduced greatly so that the gravitational center of the oil pumping device is lower and thus it is stable to prevent the pump from falling down.

In the present invention, by the unidirectional air inlet valve 25 and the unidirectional pressure relief valve 3, as the air in the pump 2 tends to pass through the unidirectional air inlet valve 25 to the oil storage space 17 along an opposite direction, or air out of the oil storage tank 1 tends to pass through the unidirectional pressure relief valve 3 to the interior of the pump 2 along an opposite direction, the air will push the piston 253 or the unidirectional pressure relief valve 3 so that the piston 253 or the unidirectional pressure relief valve 3 will tightly seal the air hole 255 of the cover 254 or the engaging hole 161 of the lower cover 16 to prevent air from flowing along an opposite direction to cause a worse pumping effect.

Furthermore, the unidirectional air inlet valve 25 of the present invention is formed by a valve body 251, a cover 254, a piston 253, a spring 257, etc. It can be assembled easily. In the present invention, only one unidirectional pressure relief valve 3 is utilized. The air can be exhausted unidirectionally. The present invention can be assembly easily and cost is reduced greatly.

Further, since the outer peripheral surface of the pump 2 has a plurality of recesses 21 which are arranged uniformly, forces may uniformly apply to the peripheral wall of the pump 2. Therefore, the peripheral wall of the pump 2 will not be destroyed in the thinner recesses.

In summary, in the present invention, air inlet valve is installed in a pump, and the pump has air inlet channels so that the air pumping or absorbing device can be assembled easily.

The present invention are thus described, it will be obvious that the same may be varied in many ways. For example, the pump has a polygonal shape, thereby, as the pump is inserted into the inner side of the positioning wall, a concave portion is formed between the pump and the positioning wall. Such variations are not to be regarded as a departure from the spirit and scope of the present invention, and all such modifications as would be obvious to one skilled in the art are intended to be included within the scope of the following claims.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An oil pumping device comprising an oil storage tank; the oil storage tank being installed with an upper cover and a lower cover, a pump being installed between the upper cover an lower cover, the upper cover and lower cover sealing a top and a bottom of the pump, respectively, the pump being installed with a piston; the piston having a handle installed out of the upper cover; an interior of the lower cover having a unidirectional pressure relief valve with respect to the pump; an outer side of the pump of the oil storage tank being defined with a oil storage space, characterized in that:

a top of the oil storage tank has an annular positioning wall extending upwards with a predetermined height; and a top of the pump is inserted into an interior of the positioning wall; and an outer peripheral surface of the pump has at least one recess; one section of the recess is enclosed by the positioning wall; another portion of the pump protrudes from the positioning wall to extend to the lower side of the positioning wall; the recess has an air inlet hole having a radial hollowed portion, thereby, the recess being communicated with the interior of the pump; and a unidirectional air inlet valve configured with respect to the air inlet hole is installed in an interior of the pump.

2. The oil pumping device as claimed in claim 1, wherein the recess axially extends and penetrates through the pump.

3. The oil pumping device as claimed in claim 1, wherein at an inner side of the pump near the top has a sealing cover; the elevation of the sealing cover is lower than the air inlet hole; and the unidirectional air inlet valve is installed on the sealing cover.

4. The oil pumping device as claimed in claim 3, wherein the unidirectional air inlet valve includes a tubular valve body and a cover; a bottom of the sealing cover has an under pan; the unidirectional air inlet valve has an air hole penetrating through the under pan; the cover being locked to a bottom of the valve body; the cover has an air hole penetrates through a top of the cover; a piston body and an elastomer are installed in the valve body; one end of the elastomer resists against the under pan of the valve body and another end thereof resists against the piston body.

5. The oil pumping device as claimed in claim 4, wherein the cover has a downward extending peripheral wall, the cover is screwed to an outer lateral surface of a top of the valve body so as to be installed to the valve body.

6. The oil pumping device as claimed in claim 1, wherein the lower cover has an engaging hole at a position with respect to an interior of the pump; and the unidirectional pressure relief valve is installed in the engaging hole.

7. The oil pumping device as claimed in claim 6, wherein the unidirectional pressure relief valve is elastic and has a post-like shape; a top of the valve has a taper portion with a shape reduced from a lower side to a top end thereof; the maximum diameter of the taper portion is larger than the diameter of the engaging hole; an outer edge of the taper portion has at least one dent axially penetrating through the taper portion; a bottom of the pressure relief valve has an under pan having a larger diameter; a diameter of the under pan is larger than the diameter of the engaging hole, a neck portion with a smaller diameter is formed between the taper portion and the under pan; an outer diameter of the neck portion is smaller than the diameter of the engaging hole; a thickness of the neck portion is larger than the thickness of the engaging hole so that a longitudinal air flowing space is formed between the neck portion and the engaging hole; the air flowing space is communicated with the dent; a thickness of the neck portion is larger than the thickness of the engaging hole, thereby, a transversal air channel is formed.

* * * * *